US012710055B2

(12) United States Patent
Shen

(10) Patent No.: US 12,710,055 B2
(45) Date of Patent: Aug. 18, 2026

(54) FAN DEVICE WITH METAL ANNULAR FRAME

(71) Applicant: COOLER MASTER CO., LTD., Taipei City (TW)

(72) Inventor: Jia-Hong Shen, Taipei City (TW)

(73) Assignee: COOLER MASTER CO., LTD., Taipei City (TW)

( * ) Notice: Subject to any disclaimer, the term of this patent is extended or adjusted under 35 U.S.C. 154(b) by 0 days.

(21) Appl. No.: 19/306,594

(22) Filed: Aug. 21, 2025

(65) Prior Publication Data

US 2026/0055779 A1 Feb. 26, 2026

(30) Foreign Application Priority Data

Aug. 23, 2024 (TW) ..... 113209127

(51) Int. Cl.

| | |
|---|---|
| ***F04D 29/52*** | (2006.01) |
| ***F04D 19/00*** | (2006.01) |
| ***F04D 25/06*** | (2006.01) |
| ***F04D 29/02*** | (2006.01) |
| ***F04D 29/64*** | (2006.01) |

(52) U.S. Cl.

CPC ..... *F04D 29/522* (2013.01); *F04D 19/002* (2013.01); *F04D 29/644* (2013.01)

(58) Field of Classification Search

CPC .. F04D 25/0613; F04D 29/668; F04D 29/526; F04D 19/002; F04D 29/023; F04D 29/522; F04D 25/08; F04D 25/166; F04D 29/325; F04D 29/547; F04D 29/644; F04D 29/646; H05K 7/20172; F01D 5/10; F05D 2300/702

See application file for complete search history.

(56) References Cited

U.S. PATENT DOCUMENTS

| | | | | |
|---|---|---|---|---|
| 7,351,032 | B2 * | 4/2008 | Horng | F04D 29/547 415/223 |
| 10,641,285 | B2 * | 5/2020 | Tu | F04D 25/08 |
| 11,661,956 | B2 | 5/2023 | Hsieh et al. | |
| 2006/0210398 | A1 * | 9/2006 | Lin | F04D 29/646 415/220 |

(Continued)

FOREIGN PATENT DOCUMENTS

| | | | |
|---|---|---|---|
| CN | 109424587 | B | 6/2021 |
| CN | 213540759 | U | 6/2021 |
| EP | 3617521 | A1 | 3/2020 |

*Primary Examiner* — Eric J Zamora Alvarez

(74) *Attorney, Agent, or Firm* — Merchant & Gould P.C.

(57) ABSTRACT

A fan device includes a fan frame having an inner annular surface and a coupling groove, the inner annular surface defining a receiving space, and the coupling groove being recessed inward from the inner annular surface. The fan device also includes a fan blade assembly rotatably disposed within the fan frame and located in the receiving space. The fan device further includes a metal annular frame coupled to the coupling groove and positioned between the fan frame and the fan blade assembly. The fan frame includes a first annular engagement portion disposed in the coupling groove, and the metal annular frame includes a second annular engagement portion disposed on a side adjacent to the coupling groove. The metal annular frame surrounds the fan blade assembly and is mechanically retained within the coupling groove.

20 Claims, 4 Drawing Sheets

(56) References Cited

U.S. PATENT DOCUMENTS

2007/0231142 A1* 10/2007 Liu ..... H05K 7/20172
416/189
2007/0242430 A1* 10/2007 Liu ..... F04D 25/0613
165/125

* cited by examiner

FAN DEVICE WITH METAL ANNULAR FRAME

CROSS-REFERENCE TO RELATED APPLICATIONS

This application is a non-provisional and claims priority to Taiwan Application No. 113209127, filed Aug. 23, 2024, the contents are thereby incorporated by reference in their entirety.

TECHNICAL FIELD

The present disclosure relates to cooling devices for electronic equipment, and more particularly to a fan device incorporating a metal annular frame that enhances mechanical stability and operational performance.

BACKGROUND

As electronic technology advances, modern processors and electronic components have gain substantial power, often producing substantial amounts of heat while in operation. To prevent thermal damage and maintain stable operation, it is essential to implement efficient thermal management solutions in electronic systems, such as active cooling fans.

The frame of a fan is generally produced via plastic injection molding. Generally, the mold used in injection molding has features with a draft angle, which facilitates demolding of the finished product. However, the inclusion of a draft angle may complicate the mold's structure and could impact the fan's performance.

Additionally, as the fan blades rotate, the entire fan vibrates. The vibration generates noise and can potentially propagate to other electronic components, compromising their stability and reliability. Therefore, a challenge for R&D personnel is to streamline the mold structure used in fan manufacturing without compromising performance, while also identifying methods to mitigate the vibration and noise generated during operation to lessen their detrimental impacts on the stability of other electronic components.

SUMMARY

In general terms, this disclosure is directed to a fan device. In some embodiment, and by non-limiting example, the present disclosure provides a fan device incorporating a metal annular frame, suitable for electronic cooling systems.

An aspect of the present disclosure provides a fan device for electronic cooling systems. The fan device includes a fan frame having an inner annular surface and a coupling groove recessed inward from the inner annular surface. The inner annular surface defies a receiving space. The fan device further includes a fan blade assembly rotatably disposed within the fan frame and located in the receiving space. The fan device also includes a metal annular frame coupled to the coupling groove and positioned between the fan frame and the fan blade assembly. The fan frame includes a first annular engagement portion disposed in the coupling groove, and the metal annular frame includes a second annular engagement portion disposed on a side adjacent to the coupling groove. The metal annular frame surrounds the fan blade assembly and is mechanically retained within the coupling groove. The metal annular frame surrounds the fan blade assembly and is mechanically retained within the coupling groove.

In some embodiments, the first annular engagement portion and the second annular engagement portion are complementarily interlocking to secure the metal annular frame within the coupling groove.

In some embodiments, the first annular engagement portion is an annular engagement protrusion and the second annular engagement portion is an annular engagement recess.

In some embodiments, the fan frame further includes at least one first microstructure disposed on the first annular engagement portion, and the metal annular frame further includes at least one second microstructure disposed on the second annular engagement portion, the first and second microstructures being complementarily interlocking.

In some embodiments, the first microstructure is an engagement protrusion and the second microstructure is an engagement recess.

In some embodiments, the first microstructure includes a first joint section and a second joint section that are connected at one end and arranged at an angle relative to each other, the second microstructure includes a third joint section and a fourth joint section that are connected at one end and arranged at an angle relative to each other, the first joint section being aligned with the third joint section, and the second joint section being aligned with the fourth joint section.

In some embodiments, the numbers of the first and second microstructures are both plural, the first microstructures are arranged circumferentially along the first annular engagement portion, and the second microstructures are arranged circumferentially along the second annular engagement portion.

In some embodiments, the metal annular frame at least partially protrudes out of the coupling groove.

In some embodiments, the metal annular frame is coupled to the coupling groove via insert molding.

In some embodiments, a minimum clearance between the fan blade assembly and the metal annular frame is 0.3 millimeters.

Another aspect of the present disclosure provides a method of assembling a fan device for electronic cooling systems. The method includes forming a fan frame having an inner annular surface and a coupling groove recessed inward from the inner annular surface, forming a first annular engagement portion in the coupling groove, forming a fan blade assembly and rotatably mounting the fan blade assembly in a receiving space defined by the inner annular surface, forming a metal annular frame with a second annular engagement portion, and inserting the metal annular frame into the coupling groove such that the metal annular frame is positioned between the fan frame and the fan blade assembly. The metal annular frame is mechanically retained within the coupling groove and surrounds the fan blade assembly.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

Figure 1:
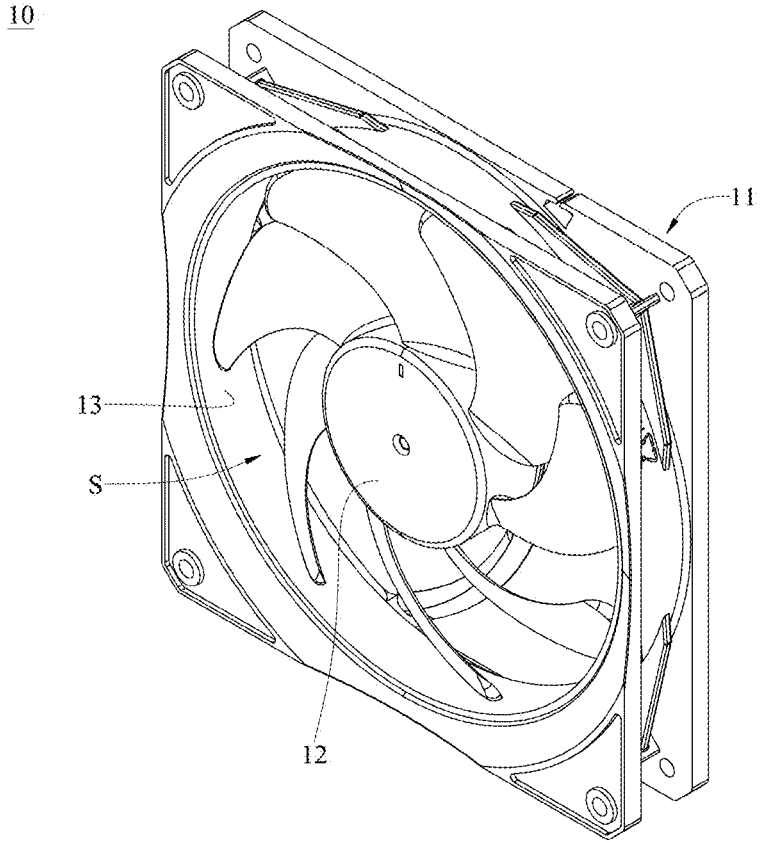
FIG. 1 is a perspective view of a fan device in accordance with one embodiment of the present invention.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
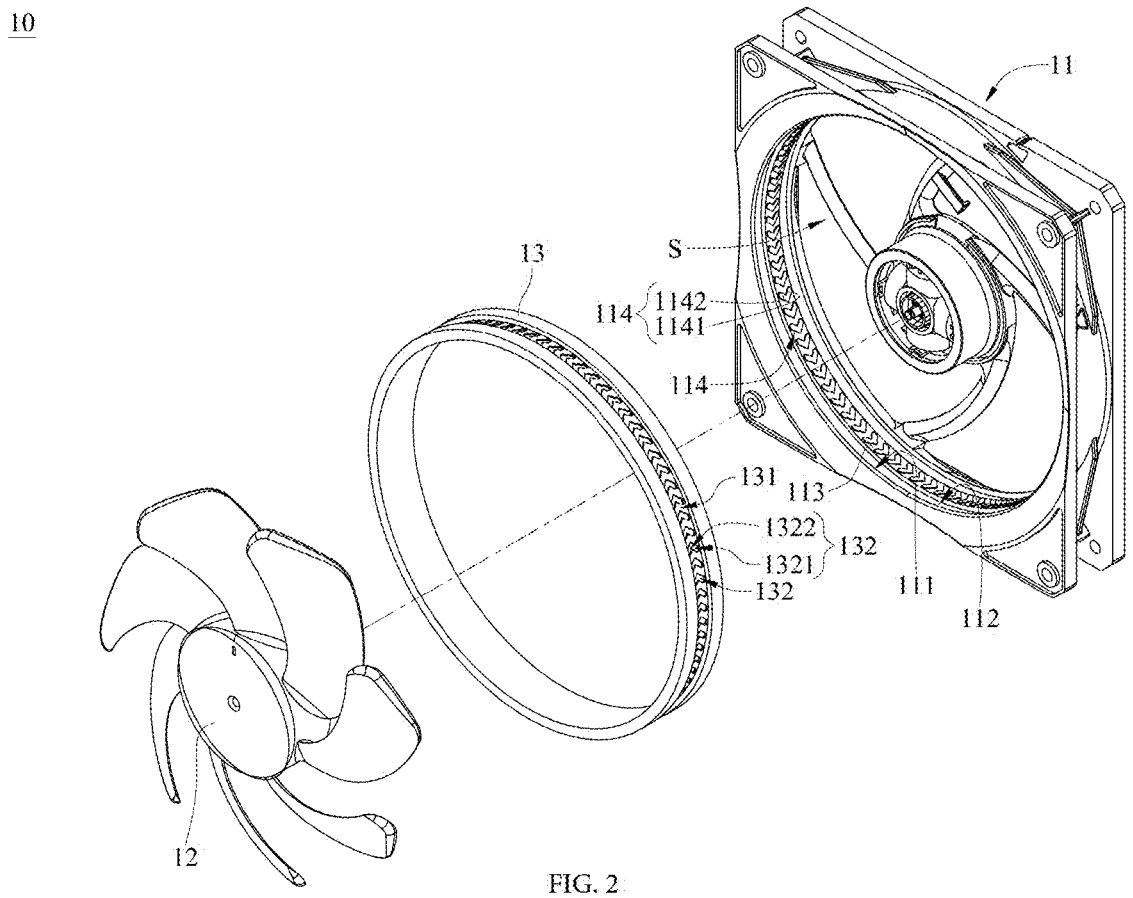
FIG. 2 is an exploded view of the fan device shown in FIG. 1.
Figure 3:
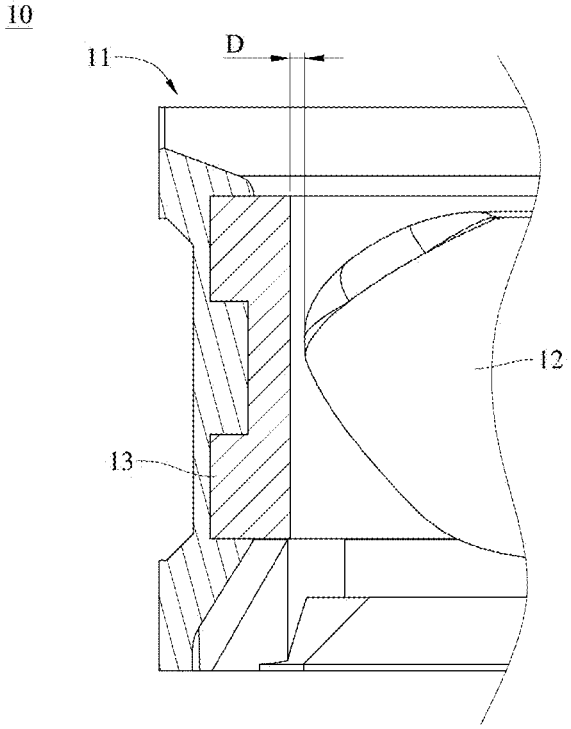
FIG. 3 is a cross-sectional view of the fan device shown in FIG. 1.

Referring to FIGS. 1-3, FIG. 1 is a perspective view of a fan device in accordance with one embodiment of the present invention. FIG. 2 is an exploded view of the fan device shown in FIG. 1. FIG. 3 is a cross-sectional view of the fan device shown in FIG. 1.

As an example illustrated in FIG. 1, the fan device 10 includes a fan frame 11, a fan blade assembly 12, and a metal annular frame 13. In one embodiment, the metal annular frame 13 is positioned between the fan frame 11 and the fan blade assembly 12. The fan device 10 is configured to enhance mechanical stability, airflow efficiency, and noise suppression t by incorporating a metal annular frame 13. Accordingly, the fan device 10 is particularly suited for electronic cooling systems that require high reliability, noise control, and heat dissipation efficiency.

In one embodiment, the fan frame 11 is made by injection molding of thermoplastic material and includes an inner annular surface 111 that defines a receiving space S for the fan blade assembly 12. A coupling groove 112 is recessed inward from the inner annular surface 111 and encircles the internal circumference of the fan frame 11. For example, the coupling groove 112 can be employed as a receiving feature to mount the metal annular frame 13.

In one embodiment, the coupling groove 112 spans the entire inner perimeter of the fan frame 11 and includes a first annular engagement portion 113. The first annular engagement portion 113 may be a continuous annular protrusion extending radially. However, the embodiment is not limited thereto. In another embodiment, the engagement portion may instead be formed as a recess.

In one embodiment, one or more first microstructures 114 are disposed along the first annular engagement portion 113 to enhance mechanical retention. The first microstructures 114 may be configured as V-shaped ridges or polygonal keys, and are arranged circumferentially with either uniform or variable spacing. Each microstructure 114 includes a first joint section 1141 and a second joint section 1142. For example, the first joint section 1141 and the second joint section 1142 meet at an angle and are not parallel, providing a locking geometry that resists torsional or axial displacement when engaged with a corresponding structure.

In one embodiment, the fan frame 11 can be made using a single-shot or multi-shot injection molding process. For example, the coupling groove 112 is formed with dimensional tolerances that allows thermal expansion or contraction during prolonged use.

In one embodiment, the fan blade assembly 12 includes a plurality of blades positioned around a central hub, which is then operably connected to a motor (not shown). The fan blade assembly 12 is rotatably supported within the receiving space S defined by the fan frame 11. Additionally, the orientation of the blade assembly may be either axial-flow or radial-flow, contingent upon the application.

In one embodiment, the tips of the fan blade assembly 12 are spaced from the surrounding metal annular frame 13 by a minimum radial clearance D, which may be approximately 0.3 mm, but may vary from 0.1 mm to 1.0 mm depending on size, tolerances, and desired airflow performance. A narrow gap enhances aerodynamic sealing while minimizing vortex leakage and noise generation.

In one embodiment, the fan blade assembly 12 may be made of lightweight plastic, composite, or reinforced polymer materials, and may include vibration dampening features if needed.

In one embodiment, the metal annular frame 13 is disposed within the coupling groove 112 and is located between the inner wall of the fan frame 11 and the fan blade assembly 12. The metal annular frame 13 completely or substantially surrounds the fan blade assembly 12. The metal annular frame 13 can be made of aluminum, stainless steel, magnesium alloy, or any other suitable material that provides both mechanical stiffness and damping capability. In one embodiment, the metal annular frame 13 may at least partially protrude out of the coupling groove 112. However, the embodiment is not limited thereto. In another embodiment, the metal annular frame may be flush with or recessed inside the fan frame surface, depending on the desired airflow profile and exposure constraints.

In one embodiment, the outer circumferential edge of the metal annular frame 13 includes a second annular engagement portion 131 that complements the first annular engagement portion 113 on the fan frame 11. For example, if the metal annular frame 13's engagement portion is a groove or recess, the second annular engagement portion 131 will be a matching protrusion, and vice versa.

In one embodiment, one or more second microstructures 132 are disposed along the second engagement portion 131 and are circumferentially arranged at either uniform or variable spacing. Each of the second microstructures 132 includes a third joint section 1321 and a fourth joint section 1322. The third joint section 1321 and the fourth joint section 1322 are also non-parallel and arranged to interlock with the first joint section 1141 and the second joint section 1142, respectively. The configuration in this geometry ensures secure fastening and prevents the metal annular frame 13 from rotating or shifting during fan operation. However, the embodiment is not limited thereto. In another embodiment, the configuration in reversed interlock geometry may also be employed, wherein the fan frame includes recesses and the metal frame includes protrusions. For example, the first microstructures could be grooves, whereas the second microstructures could be joint protrusions.

In one embodiment, the second microstructures 132 can be manufactured by CNC machining, stamping, die-casting, or additive manufacturing processes, contingent upon the selected metal and production volume.

In one embodiment, the metal annular frame 13 is insert-molded into the plastic fan frame 11, enhancing structural strength and providing additional advantages. For example, by embedding the metal annular frame 13 into the coupling groove 112 through insert molding, it enhances the vertical alignment and dimensional stability of the inner annular surface. This enhancement is crucial for reducing aerodynamic inconsistencies, improving uniformity in blade clearance, and maintaining performance throughout thermal cycling. However, the embodiment is not limited thereto. In other embodiments, the metal annular frame may be inserted into the fan frame using other suitable methods such as mechanical press-fitting, ultrasonic welding, adhesive bonding, or over-molding with multi-shot injection techniques, contingent upon design requirements, manufacturing capabilities, and desired mechanical strength.

In one embodiment, unlike the conventional design where the reinforcement frame is completely embedded, in the present design, the metal annular frame 13 is partially exposed to the outer surface of the plastic fan frame 11. The exposed configuration facilitates: streamlined mold parting line design, eliminating the necessity for intricate undercuts; direct visual assessment of the metal frame positioning after molding; enhanced heat dissipation and resonance damping.

In one embodiment, the second microstructures 132 of the metal annular frame 13 are located on the side opposite the exposed surface, naming facing the fan blade assembly 12 and coupling groove 112. This design offers several functional advantages: it ensures internal mechanical locking, minimizing wear and environmental exposure; it preserves a sleek external aesthetic, devoid of protrusions or tooling marks; it facilitates directional control of material flow during insert molding, thereby diminishing voids and sink marks.

Figure 4:
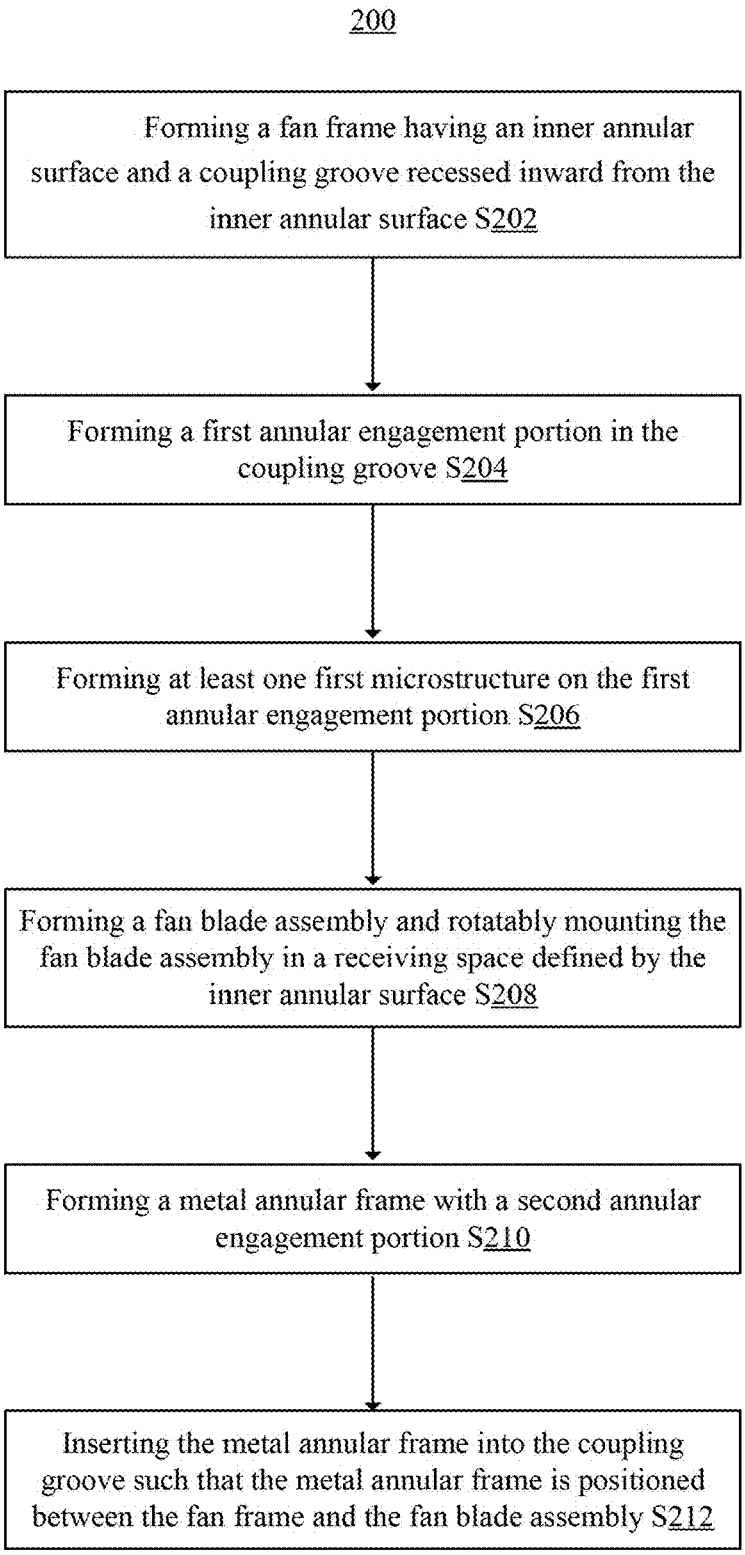
FIG. 4 is a flowchart illustrating an assembling process of the fan device shown in FIG. 1.

Referring to FIG. 4 along with FIG. 2, FIG. 4 is a flowchart illustrating an assembling process of the fan device shown in FIG. 1. As an example illustrated in FIG. 4, the assembling process 200 of the fan device 10 includes: Step 202, forming a fan frame having an inner annular surface and a coupling groove recessed inward from the inner annular surface; Step 204, forming a first annular engagement portion in the coupling groove; Step 206, forming at least one first microstructure on the first annular engagement portion; S208, forming a fan blade assembly and rotatably mounting the fan blade assembly in a receiving space defined by the inner annular surface; S210, forming a metal annular frame with a second annular engagement portion; S212, inserting the metal annular frame into the coupling groove such that the metal annular frame is positioned between the fan frame and the fan blade assembly. It should be recognized that the assembling process 200 is not exhaustive and that additional operation steps can be done as well before, after, or between any of the indicated operation steps. In some embodiments, some operational steps of the assembling process 200 may be omitted or additional operational steps may be incorporated, which are not detailed here for the sake of simplicity. In some embodiments, the operational steps of assembling process 200 may be performed in a different sequence and/or may alter.

In one embodiment, the fabrication of the fan frame in Step 202 proceeds via injection molding techniques. For example, the metal annular frame 13 is insert-molded into the fan frame 11 as part of the injection molding process. The fan frame 11 is positioned within the mold cavity, and plastic material is injected around it, creating a monolithic bond.

In one embodiment, subsequent to the formation of the fan frame 11, the fan blade assembly 12 is inserted and mounted to rotate within the receiving space S defined by the inner annular surface 111, surrounded by the metal annular frame 13.

In one embodiment, the minimum gap between the fan blade assembly 12 and metal annular frame 13 is evaluated and calibrated to a predefined value, such as 0.3 mm, to minimize noise and vibration. Additionally, to assure stability, the finished assembly may undergo balancing, vibration testing, and thermal cycling.

The fan device of the present disclosure offers multiple advantages. The exterior exposure of the metal annular frame obviate the necessity of intricate mold undercuts, thereby streamlining tooling and diminishing production expenses and cycle durations. Injection molding, particularly insert molding, facilitates economical mass production with great dimensional repeatability and excellent surface polish, while allowing for precise integration of dissimilar materials such as plastic and metal. The increased structural rigidity conferred by the integrated metal frame mitigates vibrational harmonics and blade flutter, resulting in diminished operational noise. Furthermore, the configuration enhances manufacturing precision, particularly in preserving the vertical flatness and alignment of the inner annular surface. The internal-facing engagement features enhance mechanical locking strength while maintaining the external aesthetics and functionality of the fan. Moreover, the architecture is highly modular and can be readily adapted for use in axial fans, blowers, GPU cooling fans, or CPU cooling systems.

Therefore, embodiments disclosed herein are well adapted to attain the ends and advantages mentioned as well as those that are inherent therein. The particular embodiments disclosed above are illustrative only, as the embodiments disclosed may be modified and practiced in different but equivalent manners apparent to those of ordinary skill in the relevant art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. Of course, the disclosed embodiments are merely exemplary embodiments and that various modifications can be made without departing from the spirit and scope of the disclosure. Further, it should be understood that various aspects of the embodiment are not mutually exclusive of each other and can be combined as desired by a person of ordinary skill in the art as a matter of design choices.

The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some number. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

The invention claimed is:

1. A fan device for electronic cooling systems, the fan device comprising:

a fan frame having an inner annular surface and a coupling groove radially recessed inward from the inner annular surface towards a center of the fan device, the inner annular surface defining a receiving space;

a fan blade assembly rotatably disposed within the fan frame and located in the receiving space; and a metal annular frame coupled to the coupling groove and positioned between the fan frame and the fan blade assembly, wherein:

the fan frame includes a first annular engagement portion disposed in the coupling groove, the metal annular frame includes a second annular engagement portion disposed on a side adjacent to the coupling groove, and the metal annular frame surrounds the fan blade assembly and is mechanically retained within the coupling groove.

2. The fan device of claim 1, wherein the first annular engagement portion and the second annular engagement portion are complementarily interlocking to secure the metal annular frame within the coupling groove.

3. The fan device of claim 1, wherein the first annular engagement portion is an annular engagement protrusion and the second annular engagement portion is an annular engagement recess.

4. The fan device of claim 1, wherein the fan frame further includes at least one first microstructure disposed on the first annular engagement portion, and the metal annular frame further includes at least one second microstructure disposed on the second annular engagement portion, the first and second microstructures being complementarily interlocking.

5. The fan device of claim 4, wherein the first microstructure is an engagement protrusion and the second microstructure is an engagement recess.

6. The fan device of claim 4, wherein the first microstructure includes a first joint section and a second joint section that are connected at one end and arranged at an angle relative to each other, the second microstructure includes a third joint section and a fourth joint section that are connected at one end and arranged at an angle relative to each other, the first joint section being aligned with the third joint section, and the second joint section being aligned with the fourth joint section.

7. The fan device of claim 4, further comprising a plurality of first and second microstructures, the first plurality of microstructures are arranged circumferentially along the first annular engagement portion, and the second plurality of microstructures are arranged circumferentially along the second annular engagement portion.

8. The fan device of claim 1, wherein the metal annular frame at least partially protrudes out of the coupling groove.

9. The fan device of claim 1, wherein the metal annular frame is coupled to the coupling groove via insert molding.

10. The fan device of claim 1, wherein a minimum clearance between the fan blade assembly and the metal annular frame is 0.3 millimeters.

11. A method of assembling a fan device for electronic cooling systems, the method comprising:

forming a fan frame having an inner annular surface and a coupling groove radially recessed inward from the inner annular surface towards a center of the fan device;

forming a first annular engagement portion in the coupling groove;

forming a fan blade assembly and rotatably mounting the fan blade assembly in a receiving space defined by the inner annular surface;

forming a metal annular frame with a second annular engagement portion; and inserting the metal annular frame into the coupling groove such that the metal annular frame is positioned between the fan frame and the fan blade assembly, wherein the metal annular frame is mechanically retained within the coupling groove and surrounds the fan blade assembly.

12. The method of claim 11, wherein the first annular engagement portion and the second annular engagement portion are complementarily interlocking to secure the metal annular frame within the coupling groove.

13. The method of claim 11, wherein the first annular engagement portion includes an annular engagement protrusion and the second annular engagement portion includes an annular engagement recess.

14. The method of claim 11, further comprising forming at least one first microstructure on the first annular engagement portion and at least one second microstructure on the second annular engagement portion, wherein the first and second microstructures are complementarily interlocking.

15. The method of claim 14, wherein the first microstructure is an engagement protrusion and the second microstructure is an engagement recess.

16. The method of claim 14, wherein the first microstructure includes a first joint section and a second joint section that are connected at one end and arranged at an angle relative to each other, the second microstructure includes a third joint section and a fourth joint section that are connected at one end and arranged at an angle relative to each other, the first joint section being aligned with the third joint section, and the second joint section being aligned with the fourth joint section.

17. The method of claim 14, further comprising a plurality of first and second microstructures, the first plurality of microstructures are arranged circumferentially along the first annular engagement portion, and the second plurality of microstructures are arranged circumferentially along the second annular engagement portion.

18. The method of claim 11, wherein the metal annular frame at least partially protrudes out of the coupling groove.

19. The method of claim 11, wherein the metal annular frame is coupled to the coupling groove via insert molding.

20. The method of claim 11, wherein a minimum clearance between the fan blade assembly and the metal annular frame is 0.3 millimeters.

* * * * *